US005799887A

United States Patent [19]

Kroger

[11] Patent Number: 5,799,887

[45] Date of Patent: Sep. 1, 1998

[54] CUTTING CYLINDER FOR A DOCUMENT SHREDDING MACHINE

[75] Inventor: Bruce R. Kroger, West Chicago, Ill.

[73] Assignee: Fellowes Mfg. Co., Itasca, Ill.

[21] Appl. No.: 740,201

[22] Filed: Oct. 24, 1996

[51] Int. Cl.[6] ..... B02C 18/16

[52] U.S. Cl. ..... 241/236; 241/295; 241/293

[58] Field of Search ..... 29/888.1, 421.1, 29/523; 241/293, 295, 236

[56] References Cited

U.S. PATENT DOCUMENTS

| | | | |
|---|---|---|---|
| 4,082,232 | 4/1978 | Brewer | 241/236 |
| 4,558,827 | 12/1985 | Berger | 241/295 X |
| 4,565,330 | 1/1986 | Katoh | 241/293 X |
| 4,660,269 | 4/1987 | Suzuki | 29/421.1 X |
| 4,809,562 | 3/1989 | Bendoraitas et al. | 29/888.1 |
| 4,847,963 | 7/1989 | Bendoraitas et al. | 29/888.1 |
| 4,875,270 | 10/1989 | Krips et al. | 29/421.1 |
| 5,048,767 | 9/1991 | Mori | 241/295 X |
| 5,071,080 | 12/1991 | Herbst et al. | 241/236 X |
| 5,135,178 | 8/1992 | Strohmeyer | 241/295 |
| 5,295,633 | 3/1994 | Kimbro et al. | 241/236 X |
| 5,511,732 | 4/1996 | Kroger et al. | 241/236 X |
| 5,611,495 | 3/1997 | Williams | 241/236 X |
| 5,636,801 | 6/1997 | Kroger | 241/295 X |

*Primary Examiner*—Daniel W. Howell
*Assistant Examiner*—Julie A. Krolikowski
*Attorney, Agent, or Firm*—Sean M. Sullivan; Brinks Hofer Gilson & Lione

[57] ABSTRACT

A cutting cylinder for a paper shredder has a shaft with a first end and a second end. A plurality of spaced-apart cutter discs are arranged on the shaft between the first and second ends of the shaft. Each cutter disc has an inner surface defining an inner diameter. In addition, the shaft has a first outer surface lining the inner surface of at least one cutter disc, and a second outer surface adjacent to at least one cutter disc. The second outer surface has an outer diameter greater than the inner diameter of the adjacent cutter disc.

11 Claims, 2 Drawing Sheets

20
22
24
26
28
4
40
42
44
46
48
6
60'
70'
80
82a
82b
86a
86b
88a
88b

CUTTING CYLINDER FOR A DOCUMENT SHREDDING MACHINE

BACKGROUND OF THE INVENTION

This invention relates to a cutting cylinder for a document shredding machine and a method for making the cutting cylinder.

In order to destroy documents to preserve their confidentiality, shredders exist which cut the paper into narrow strips or chips. Typically, the cutting is achieved by a pair of cutting cylinders having a series of circular cutters arranged along the axis of a solid shaft. The cutters of one shaft are offset so that the cutters pass between the cutters of the other shaft. In addition, the cutters may be either a straight cut type, which produces narrow strips of paper, or a cross cut type, which produces small paper chips.

Generally, the cutting cylinders used in paper shredders are made in one of two ways. First, the cutters and shaft are machined together to form an integral cutting cylinder of solid metal. The cutting cylinder is then hardened to withstand the rigors of cutting paper. There are several problems, however, with this method of making a cutting cylinder. For instance, extensive machining of a cutting cylinder can be very expensive and is limited in the types and shapes of cutters that can be used for the cutting cylinder. Also, while it is necessary to sufficiently harden the integral cutting cylinder to make it resistant to paper clips and other foreign material, it is both expensive and difficult to do so without the risk of warping the cutting cylinder. Additionally, it is often desirable to use a different material for the cutting shaft than the cutters.

The second way of making a cutting cylinder is to stack individual cutters and spacers onto a shaft with some feature to prevent the cutters from rotating about the shaft, such as a hexagonal cross-section, a groove, or a spline. This method of making a cutting cylinder allows the use of a wide variety of cutting materials and types of cutters, but it requires either expensive stacking machinery or a high labor content. In addition, the use of spacers between the cutters increases the total amount of parts used and the cost of making the shredder. Moreover, in a cross cut type shredder, the indexing of the cutters can result in a level of complexity that makes manual stacking very difficult and costly.

Accordingly, it is an object of the present invention to provide a cutting cylinder for a paper shredder that is an improvement over the above prior art cutting cylinders. In the present invention, a cutting cylinder is provided with a hollow shaft and a plurality of cutter discs arranged along the axis of the shaft. The shaft is expanded outward against and around each of the cutter discs to lock the lateral and rotational positions of the cutter discs about the shaft. As a result, the cutting cylinder of the present invention may have cutter discs with a wide variety of different shapes, cut types, and materials, and yet still have very few parts.

It is also another object of the present invention to provide a method of making this cutting cylinder that is an improvement over the previously described prior art methods of making cutting cylinders for paper shredders. In the method of the present invention, cutter discs are placed in a fixture or mold that correctly spaces them apart and, in the case of cross cut type cutter discs, permits adjustment of their rotational position. A shaft is next slid through the central bores of the cutter discs, and then expanded outward against and around the cutter discs to lock their lateral and rotational positions about the shaft. As a result, the method of the present invention provides a simple, inexpensive, and fast way of making a cutting cylinder for a paper shredder. The method of the present invention also provides a great deal of precision in adjusting the lateral and rotational positions of the cutter discs about the shaft, and permits the use of cutter discs having a wide variety of shapes, cut types, and materials.

SUMMARY OF THE INVENTION

The present invention provides a cutting cylinder for a paper shredder comprising a shaft having a first end and a second end, and a plurality of spaced-apart cutter discs arranged on the shaft between the first and second ends. Each cutter disc has an inner surface defining an inner diameter. In addition, the shaft has a first outer surface lining the inner surface of at least one cutter disc, and a second outer surface adjacent to at least one cutter disc. The second outer surface has an outer diameter greater than the inner diameter of the adjacent cutter disc.

In the method of making the cutting cylinder of the present invention, a plurality of cutter discs having a central bore and an inner surface are provided. A shaft is passed through the central bores of the cutter discs, and the shaft is then expanded against the inner surface of at least one cutter disc.

DETAILED DESCRIPTION OF THE PREFERRED EMBODIMENTS

Figure 1:
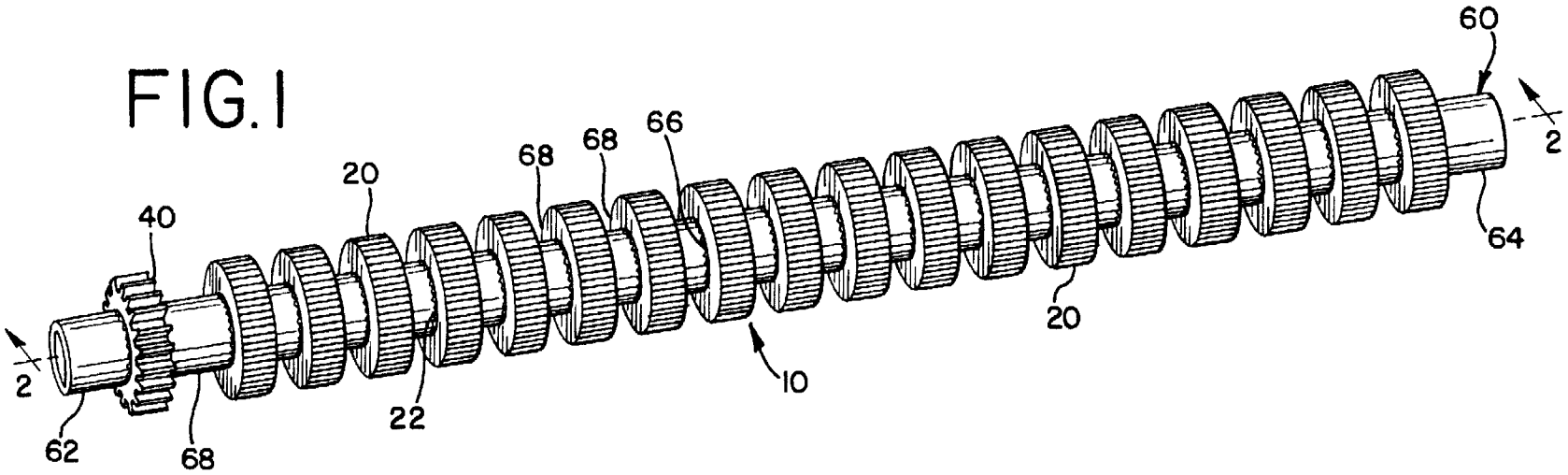
FIG. 1 is a perspective view of a cutting cylinder of the present invention.

Turning now to the drawings, FIG. 1 shows the prefer red embodiment of the cutting cylinder 10 of the present invention. The cutting cylinder 10 comprises a plurality of cutter discs 20, a driving gear 40 and a shaft 60.

Figure 2:
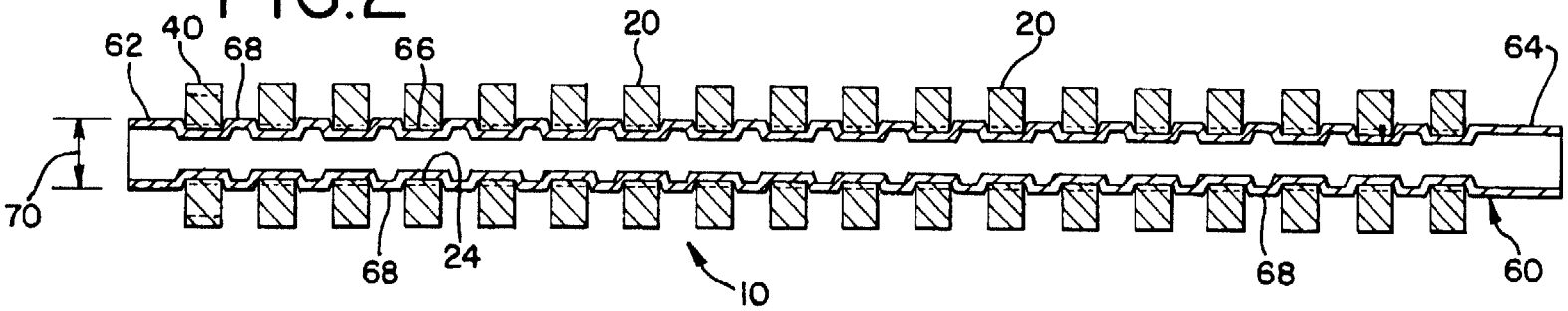
FIG. 2 is a cross-sectional view of the cutting cylinder of FIG. 1 taken along line 2—2.
Figures 3, 4, 5, 6, 7:
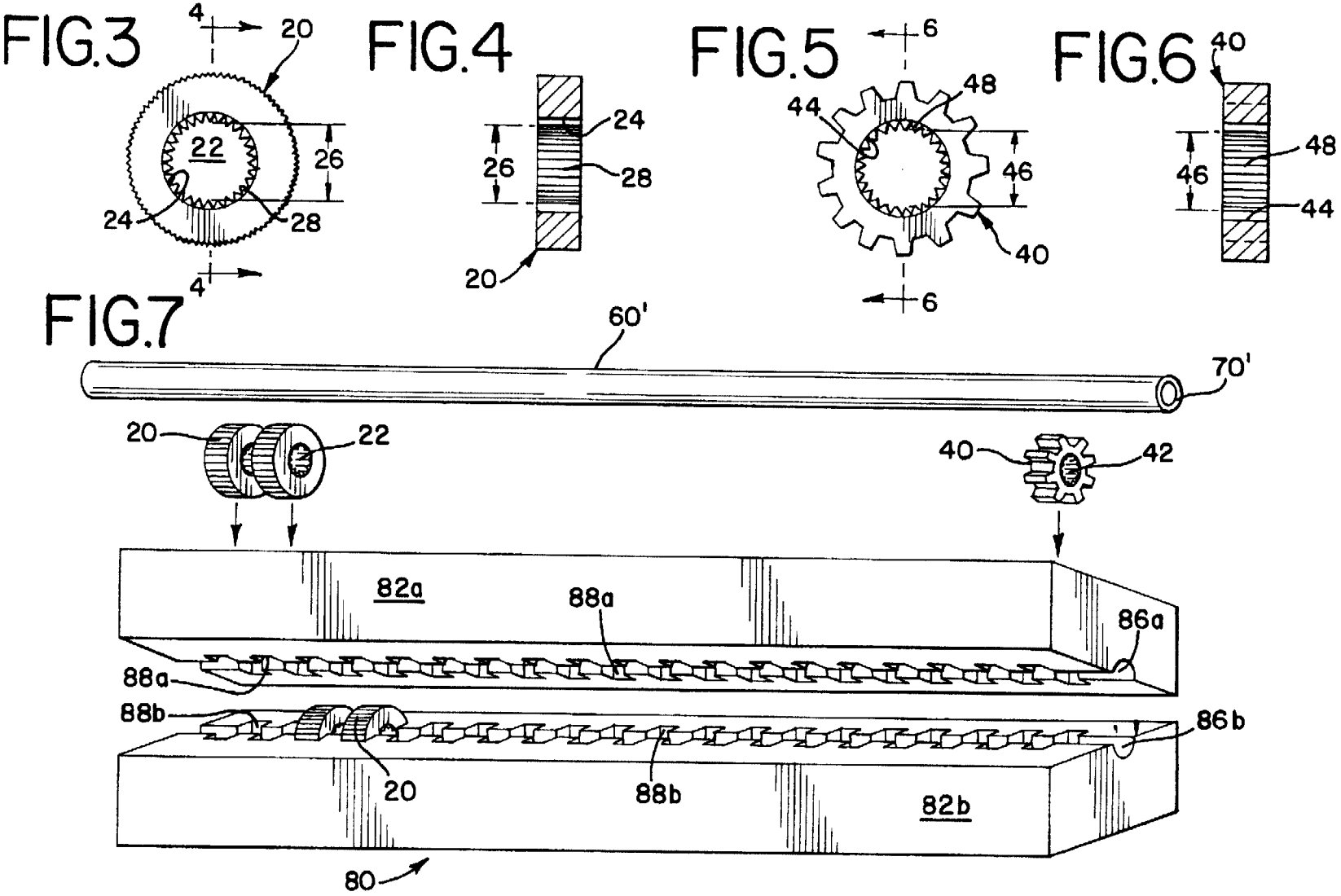
FIG. 3 is a side view of a cutter disc of the cutting cylinder of FIG. 1.
FIG. 4 is a cross-sectional view of the cutter disc of FIG. 3 taken along line 4—4.
FIG. 5 is a side view of a driving gear of the cutting cylinder of FIG. 1.
FIG. 6 is a cross-sectional view of the driving gear of FIG. 5 taken along line 6—6.
FIG. 7 is a perspective view of a fixture, a shaft, a driving gear, and cutter discs used in a method of the present invention for making the cutting cylinder of FIG. 1.

As shown in FIGS. 1–2, the cutter discs 20 are arranged on the shaft 60 with each cutter disc spaced apart from the other. In particular, the cutter discs are sufficiently separated from each other to receive cutter discs from another cutting cylinder in an interleaving fashion. Each cutter disc 20 has a central bore 22 with an inner surface 24 that defines an inner diameter 26, as best shown in FIGS. 3–4. Preferably, the inner surface 24 of each cutter disc 20 also has a plurality of splines 28 that abut the outer surface of the shaft 20. It is believed that the splines help to anchor the cutter discs to the shaft and prevent the cutter discs from rotating about the shaft.

The cutter discs 20 may be any type of cutter disc known in the prior art. In particular, the cutter discs 20 may be either a straight cut type, as shown in FIGS. 1–4, or, a cross-cut type as disclosed in U.S. Pat. No. 5,295,633, commonly assigned with the present application and specifically in corporated herein by reference. In addition the cutter discs may be made out of any desirable material, such as metal or plastic, that has a strength and hardness sufficient for the intended cutting. Preferably, the cutter discs are made out of sintered, stamped, or machined metal.

The driving gear 40 may be arranged on the shaft 60 near either end of the shaft. As best shown in FIGS. 5–6, the driving gear 40 has a central bore 42 with an inner surface 44 that defines an inner diameter 46. Preferably, the central bore, the inner surface, and the inner diameter of the driving gear and the cutter discs are identical. Similar to the cutter discs, the inner surface 44 of the driving gear 40 preferably has a plurality of splines 48 that abut the outer surface of the shaft 60. It is believed that the splines help to anchor the driving gear to the shaft and prevent the driving gear from rotating about the shaft. Although in the preferred embodiment, a drive gear is provided, it should be understood that the drive gear may be dispensed with. Alternatively, more than one gear may be provided, for example, one on either end of the shaft.

When the cutting cylinder is used in a paper shredder, the driving gear may be coupled to another gear (or series of gears) that is connected to a drive motor (not shown). During operation, the drive motor drives and rotates its own gear (or gears) which in turn drives and rotates the drive gear 40. Since the drive gear 40 is fixedly mounted, the shaft 60 will also be rotated.

The driving gear 40 may be made out of any desirable material, such as metal or plastic, that has a strength and hardness sufficient for meshing with and driving the gear or gears of the drive motor. Similar to the cutter discs, the driving gear is preferably made out of sintered, stamped, or machined metal.

As shown in FIGS. 1–2, the shaft 60 is a hollow cylindrical tube with a first end 62 and a second end 64 spaced from the first end. The shaft 60 has a first outer surface 66 and a second outer surface 68. The first outer surface 66 lines the inner surfaces 24, 44 of the cutter discs 20 and the driving gear 40, respectively, so that the cutter disc and drive gear, if present, are fixedly mounted to the shaft. The second outer surface 68 is adjacent to the cutter discs and the driving gear, and has an outer diameter 70 that is greater than the inner diameter 26 of the adjacent cutter discs and the inner diameter 46 of the driving gear. As a result, the cutter discs and the driving gear are restrained from substantial lateral movement along the shaft.

Preferably, the shaft has a circular cross-section, although it is conceivable that the shaft could have a cross-section with a variety of different geometric configurations. Additionally, the shaft 60 may be made out of any desirable material, such as aluminum, steel, or plastic, that has good strength and ductility. The shaft is preferably made out of steel that is relatively softer than the material used for the cutter discs and the driving gear. As a result, the shaft will expand under applied force or pressure before the cutter discs and the driving gear.

Turning now to FIG. 7, the method of the present invention for making the cutting cylinder 10 will now be described. First, a fixture 80 is provided with a first section **82*a* and a second section 82*b* that is preferably a mirror image of the first section. Each section has a lateral slot 86*a*, 86*b* and a plurality of radial slots 88*a*, 88*b* each arranged along the lateral slot and spaced apart. The lateral slots 86*a*, 86*b* have a width and a shape that conforms to the second outer surface 68 of the shaft 60. During expansion of the shaft, the lateral slots 86*a*, 86*b* provide a smooth and straight guide for the shaft to conform to between the cutter discs and on the ends of the shaft. The radial slots 88*a*, 88*b*, on the other hand, have a size and shape that conforms to the cutter discs 20. When a drive gear is provided, each section is provided with a radial slot that has a size and shape that conforms to the driving gear 40**.

Next, the cutter discs 20 and the driving gear 40 (if desired) are placed in the corresponding radial slots of one of the sections of the fixture. While in these radial slots, all of the central bores 22 of the cutter discs and the central bore 42 of the driving gear are aligned with each other. If the cutter discs are of the cross cut type, they may also be indexed in their radial slots to adjust their rotational position with respect to the other cutter discs.

A shaft 60' is then passed through the central bores of each cutter disc and the driving gear, when present, with the shaft 60' being aligned parallel to the lateral slot. Preferably, the shaft 60' is hollow and has a continuous outer diameter 70' that is smaller than the inner diameters 26, 46 of the cutter discs 20 and the driving gear 40, respectively.

Next, the first and second sections **82*a*, 82*b* of the fixture 80 are fastened together, one on top of the other, with their lateral slots 86*a*, 86*b* aligned with each other and their radial slots 88*a*, 88*b*** aligned with each other. The sections may be fastened in a number of different ways, but preferably, are hinged together on one side and clamped down together on the other side. The sections are clamped together tightly enough to withstand the pressure used to expand the shaft and to provide a consistent outer surface for the shaft to conform to between the cutter discs and on the ends of the shaft. As a result of the first and second sections being fastened together with their slots in alignment, the cutter discs and driving gear are fixedly held in their lateral and rotational positions in the fixture.

The shaft 60' is then expanded outward against and around the inner surfaces 24, 44 of the cutter discs 20 and the driving gear 40, respectively. The shaft 60' may be expanded in a number of different ways. Preferably, the shaft is expanded by pumping a hydraulic fluid such as water through the shaft with a high amount of pressure. The amount of pressure used depends on the size, thickness, and material of the shaft being expanded. As an illustrative example, water may be pumped through a 0.5 inch steel shaft having a 0.035 inch thick wall at a pressure of about 18,000 pounds per square inch.

The shaft may also be expanded by driving a mandrel or a ball bearing through the shaft. The mandrel and ball bearing would have an outer diameter greater than the inner diameter 70' of the shaft 60', but smaller than the inner diameter of the cutter discs and the driving gear. As a result, the mandrel or ball bearing would expand the shaft outward against and around the inner surfaces of the cutter discs and the driving gear as the mandrel or ball bearing passes through the hollow shaft. The mandrel or ball bearing could be driven through the hollow shaft by hydraulic, pneumatic, or explosive pressure, mechanical jacking, or any other suitable means that can apply the requisite force. After expanding the shaft, the mandrel, or a portion thereof, may also be left inside the hollow shaft to provide extra support for the shaft.

As a result of the expansion, the outer surface of the shaft 60' lines the inner surface of the cutter discs and the driving gear so that cutter discs and the driving gear are fixed from substantial rotation about the expanded shaft as well as from substantial lateral movement along the expanded shaft. Accordingly, once the shaft 60' is expanded, it becomes the shaft 60 described above with first and second outer surfaces 66, 68.

After the shaft 60' has been expanded, the two sections 82*a*, 82*b* of the fixture 80 are opened and separated, and a completed cutting cylinder 10 is removed from the fixture. Due to the lateral slots of the fixture, the ends of the shaft are smooth and straight, and may serve as journals to support the cutting cylinder as it turns in a pair of bearings or bearing plates (not shown). At this point, any unwanted excess material may be trimmed off the ends of the shaft of the cutting cylinder.

The cutting cylinder 10 of the present invention may be used in a variety of different paper shredding machines. Examples of paper shredders suitable for use with the cutting cylinder of the present invention are disclosed in U.S. Pat. Nos. 5,071,080 and 5,511,732, both commonly assigned with the present application and specifically incorporated herein by reference.

In operation, the present invention can be used with particular advantage in a paper shredder for the office or the home. Since there are relatively few components in the cutting cylinder and the shaft of the cutting cylinder may be hollow, the cutting cylinder of the present invention is lightweight and inexpensive. In addition, by expanding the shaft outward against and around the cutter discs, the cutting cylinder of the present invention can be made with precision and a wide range of shapes, cut types, and materials. Moreover, the method of the present invention for making cutting cylinders incurs a lower cost and a faster production rate than the machining and stacking methods known in the prior art.

It should be understood that a wide range of changes and modifications can be made to the embodiments described above. It is therefore intended that the foregoing description illustrates rather than limits this invention, and that it is the following claims, including all equivalents, which define this invention.

What is claimed is:

1. A cutting cylinder for a paper shredder comprising:

a shaft having a first end and a second end; and a plurality of spaced-apart cutter discs arranged on the shaft between the first and second ends of the shaft, each cutter disc having a unitary body with an inner surface defining an inner diameter;

wherein the shaft has a first outer surface lining the inner surface of at least one cutter disc and a second outer surface adjacent to at least one cutter disc, the second outer surface having an outer diameter greater than the inner diameter of the adjacent cutter disc.

2. The cutting cylinder of claim 1 wherein the inner surface of at least the lined cutter disc further comprises a plurality of splines.

3. The cutting cylinder of claim 1 further comprising a driving gear arranged on the shaft near one end of the shaft, the driving gear having an inner surface defining an inner diameter.

4. The cutting cylinder of claim 3 wherein the first outer surface also lines the inner surface of the driving gear, the second outer surface is also adjacent to the driving gear, and the outer diameter of the second outer surface is also greater than the inner diameter of the driving gear.

5. The cutting cylinder of claim 1 wherein the shaft is hollow.

6. In combination with a paper shredder having a top housing, a cutting mechanism including at least one cutting cylinder, and a bottom base, the cutting cylinder comprising:

a shaft having a first end and a second end; and a plurality of spaced-apart cutter discs arranged on the shaft between the first and second ends of the shaft, each cutter disc having a unitary body with an inner surface defining an inner diameter;

wherein the shaft has a first outer surface lining the inner surface of at least one cutter disc and a second outer surface adjacent at least one cutter disc, the second outer surface having an outer diameter greater than the inner diameter of the adjacent cutter disc.

7. The cutting cylinder of claim 6 wherein the cutter discs are sufficiently spaced apart from each other to receive cutter discs from another cutting cylinder in an interleaving fashion.

8. The cutting cylinder of claim 6 wherein the inner surface of at least the lined cutter disc further comprises a plurality of splines.

9. The cutting cylinder of claim 6 further comprising a driving gear arranged on the shaft near one end of the shaft, the driving gear having an inner surface defining an inner diameter.

10. The cutting cylinder of claim 9 wherein the first outer surface also lines the inner surface of the driving gear, the second outer surface is also adjacent to the driving gear, and the outer diameter of the second outer surface is also greater than the inner diameter of the driving gear.

11. The cutting cylinder of claim 6 wherein the shaft is hollow.

* * * * *